US007380285B1

(12) United States Patent
Moreno

(10) Patent No.: US 7,380,285 B1
(45) Date of Patent: Jun. 3, 2008

(54) PLAYSUIT APPARATUS

(76) Inventor: Samuel Moreno, 328 S. Eastern Ave., Los Angeles, CA (US) 90022

( * ) Notice: Subject to any disclaimer, the term of this patent is extended or adjusted under 35 U.S.C. 154(b) by 598 days.

(21) Appl. No.: 11/129,713

(22) Filed: May 16, 2005

(51) Int. Cl.
*A41D 3/00* (2006.01)

(52) U.S. Cl. ..... 2/69; 2/244

(58) Field of Classification Search ..... 2/69, 2/246, 244, 88, 6.1; 43/3; 446/26, 27, 28, 446/62

See application file for complete search history.

(56) References Cited

U.S. PATENT DOCUMENTS

| | | | | |
|---|---|---|---|---|
| 1,178,165 | A | 4/1916 | Lupton Jr. | |
| 2,018,062 | A * | 10/1935 | Hardt | 280/810 |
| 2,619,639 | A * | 12/1952 | Hendler | 2/423 |
| D172,908 | S | 8/1954 | Schultheiss | |
| 2,810,576 | A * | 10/1957 | Massey | 472/70 |
| 2,810,985 | A | 10/1957 | Bilder | |
| D193,101 | S | 6/1962 | Del Grosso | |
| 3,400,406 | A * | 9/1968 | Aileo | 2/423 |
| D256,736 | S | 9/1980 | Bajork | |
| 4,220,299 | A | 9/1980 | Motter | |
| D328,618 | S | 8/1992 | Wiley | |
| 5,299,966 | A * | 4/1994 | Rose, III | 446/62 |
| D351,493 | S | 10/1994 | DeCinque | |
| 5,713,603 | A * | 2/1998 | Carter | 280/810 |
| 5,742,939 | A * | 4/1998 | Williams | 2/69 |
| 5,747,144 | A | 5/1998 | Beige et al. | |
| 5,956,764 | A | 9/1999 | Sabin | |
| 6,041,436 | A * | 3/2000 | Keen | 2/69 |
| 6,073,882 | A * | 6/2000 | Zieger | 244/49 |
| 6,099,041 | A * | 8/2000 | Carter | 280/810 |
| 6,217,113 | B1 * | 4/2001 | Knatz | 297/118 |
| 6,401,249 | B2 * | 6/2002 | Haar et al. | 2/69 |
| 6,685,135 | B2 * | 2/2004 | Geissler | 244/4 A |
| 6,745,400 | B1 * | 6/2004 | Paciorkowski | 2/69 |
| 6,922,848 | B1 * | 8/2005 | Stanley | 2/69 |
| 7,037,163 | B2 * | 5/2006 | Beard | 446/28 |
| 7,097,134 | B1 * | 8/2006 | Blum | 244/4 A |
| 7,175,496 | B1 * | 2/2007 | Lund et al. | 446/28 |
| 7,257,846 | B2 * | 8/2007 | Paciorkowski | 2/267 |
| 2002/0073476 | A1 * | 6/2002 | Jastrab et al. | 2/88 |
| 2004/0093653 | A1 * | 5/2004 | Beard | 2/1 |

* cited by examiner

*Primary Examiner*—Alissa L Hoey

(57) ABSTRACT

A playsuit apparatus includes a lower body covering that includes a pair of leg coverings and an upper body covering that includes a pair of arm coverings, a back covering and a chest covering. A housing is attached to the back covering. The housing has a first side wall and a second side wall. Each of the first and second side walls has an elongated vertical slot extending therethrough. A pair of wing assemblies is provided and each is positioned in the housing and each is biased outwardly out of a corresponding one of the slots. A pair of actuators is mounted on the housing. Each of the actuators is configured to engage one of the wing assemblies and retain the wing assemblies within the housing. The actuators release the wing assemblies outwardly of the slots when the actuators are actuated.

11 Claims, 6 Drawing Sheets

PLAYSUIT APPARATUS

BACKGROUND OF THE INVENTION

1. Field of the Invention

The present invention relates to playsuit devices and more particularly pertains to a new playsuit device for being positionable and entertaining a child.

2. Description of the Prior Art

The use of playsuit devices is known in the prior art. U.S. Pat. No. 5,747,144 describes a costume having both flexible and rigid components and a method of fabricating such. Another type of playsuit device is U.S. Pat. Des. No. 172,908 which includes a spacesuit type suit which may be worn by a child during playtimes. Still yet another such device is found in U.S. Pat. Des. No. 256,736 which resembles a knight positioned on a horse. A costume resembling a plane is found in U.S. Pat. Des. No. 328,618.

While these devices fulfill their respective, particular objectives and requirements, the need remains for a device which includes a stretchable body covering which includes a plurality of toys attached thereto. Such toys may include toy missile launcher, a toy rocket pack and wings which may be selectively extendable outwardly away from the body covering. The device should also include protection against falls for a person wearing the body covering.

SUMMARY OF THE INVENTION

The present invention meets the needs presented above by generally comprising a lower body covering that includes a pair of leg coverings and an upper body covering that includes a pair of arm coverings, a back covering and a chest covering. A housing is attached to the back covering. The housing has a back wall, a front wall, a top wall, a first side wall, a second side wall and a bottom wall. Each of the first and second side walls has an elongated vertical slot extending therethrough. A pair of wing assemblies is provided and each is positioned in the housing and each is biased outwardly out of a corresponding one of the slots. A pair of actuators is mounted on the housing. Each of the actuators is configured to engage one of the wing assemblies and retain the wing assemblies within the housing. The actuators release the wing assemblies outwardly of the slots when the actuators are actuated.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
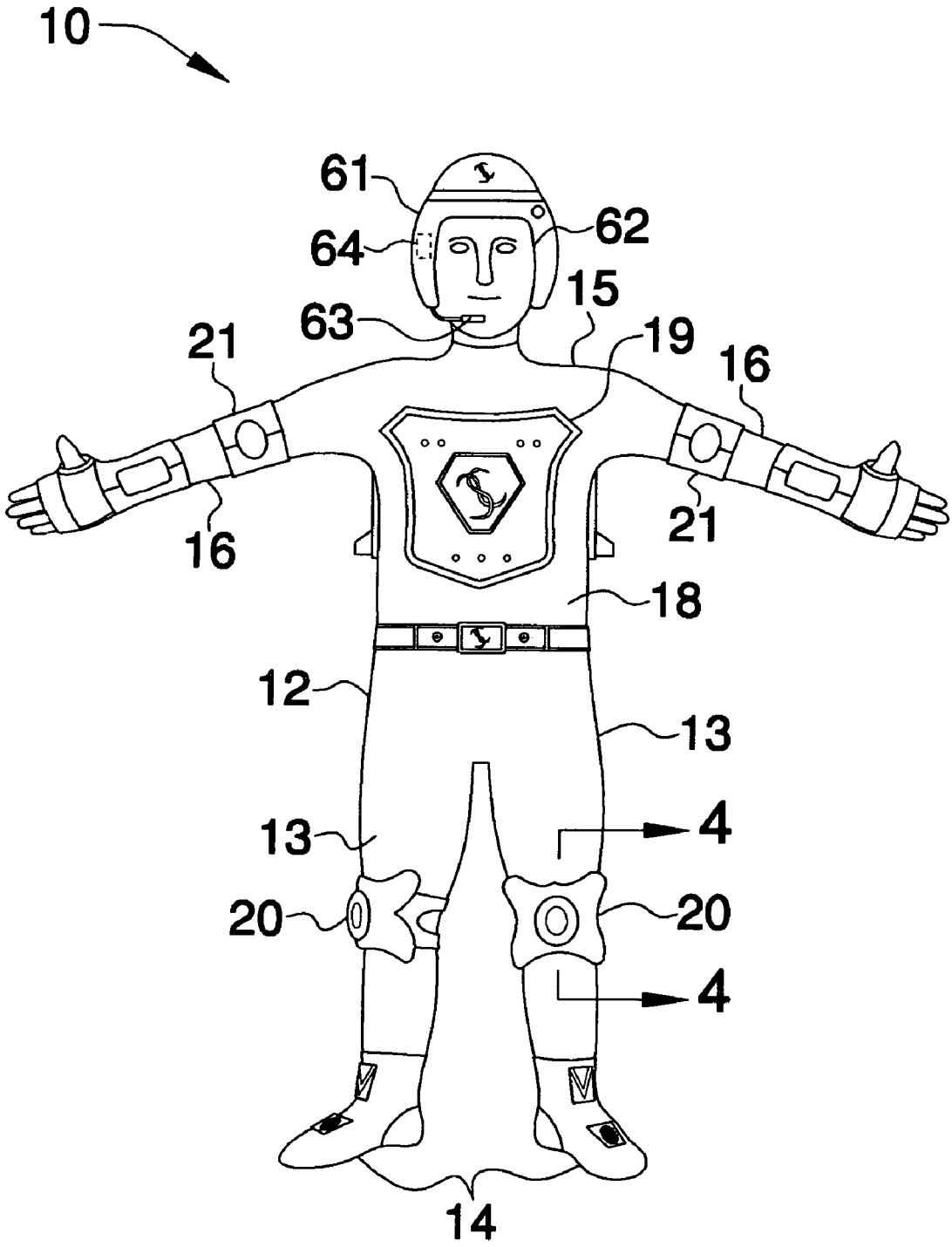
FIG. 1 is a front view of a playsuit apparatus according to the present invention.
Figure 2:
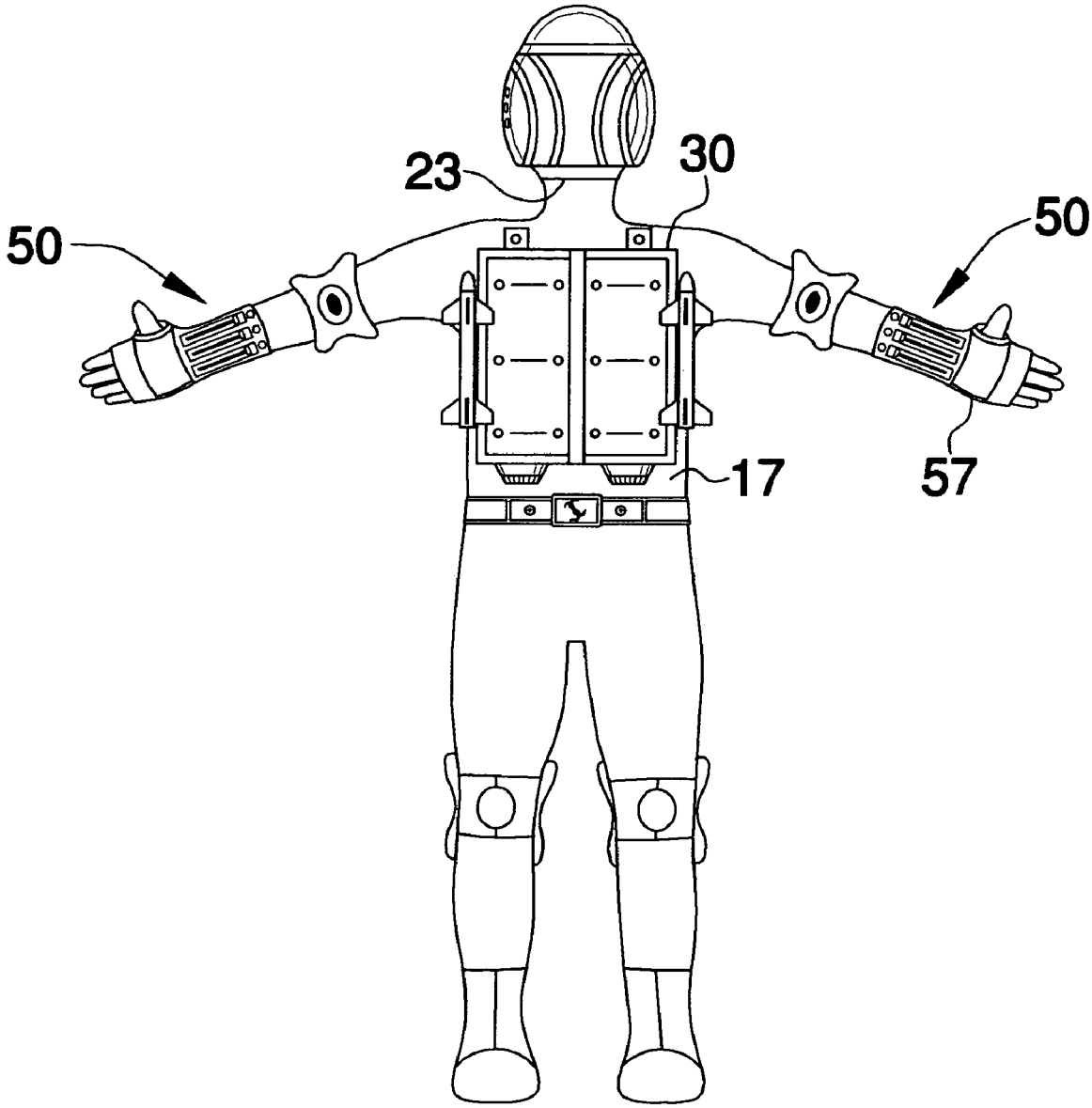
FIG. 2 is a back view of the present invention.
Figure 3:
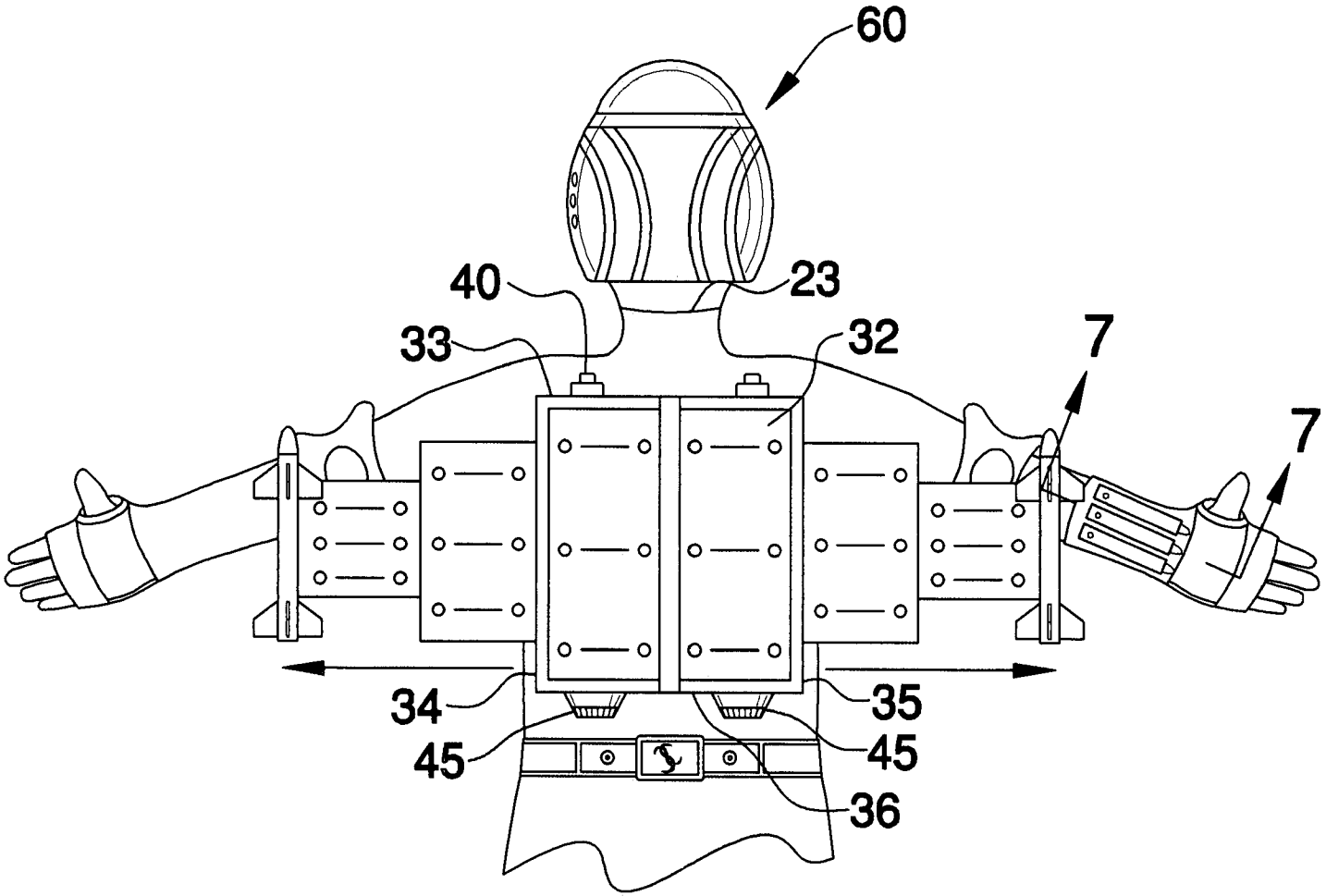
FIG. 3 is an enlarged back view of the present invention.
Figure 4:
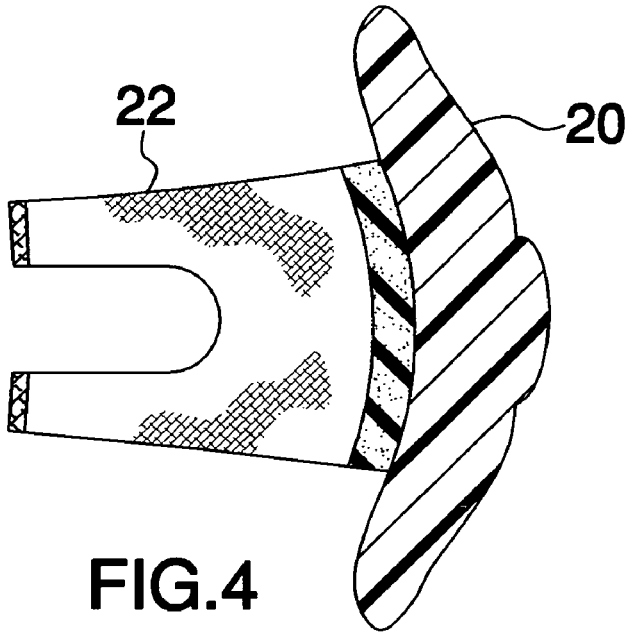
FIG. 4 is a cross-sectional view taken along line 4-4 of FIG. 1 of the present invention.

With reference now to the drawings, and in particular to FIGS. 1 through 8 thereof, a new playsuit device embodying the principles and concepts of the present invention and generally designated by the reference numeral 10 will be described.

As best illustrated in FIGS. 1 through 8, the playsuit apparatus 10 generally comprises a lower body covering 12 that includes a pair of leg coverings 13 and a pair of foot coverings 14. The foot coverings 14 may be removably secured to the lower body covering 12 with hook and loop couplers. The lower body covering 12 comprises a resiliently stretchable material. An upper body covering 15 includes a pair of arm coverings 16, a back covering 17 and a chest covering 18. The upper body covering 15 comprises a resiliently stretchable material. The resiliently stretchable material is preferably a synthetic cloth material. A shield 19 is attached to and generally covers the chest covering 18. The shield 19 may be constructed of a plastic material. A pair of knee pads 20 and a pair of elbow pads 21 are each provided. Each of the knee pads 20 is mounted on one of the leg coverings 13 and each of the elbow pads 21 is mounted on one of the arm coverings 16. The knee 20 and elbow 21 pads may be removably attached to the upper 15 and lower 12 body coverings with straps 22 which may be attached together with hook and loop couplers. The upper body covering 15 may include a neck opening 23 or may include an attached head cover which can be removably positioned on a head of a child wearing the upper body covering 15.

Figure 5:
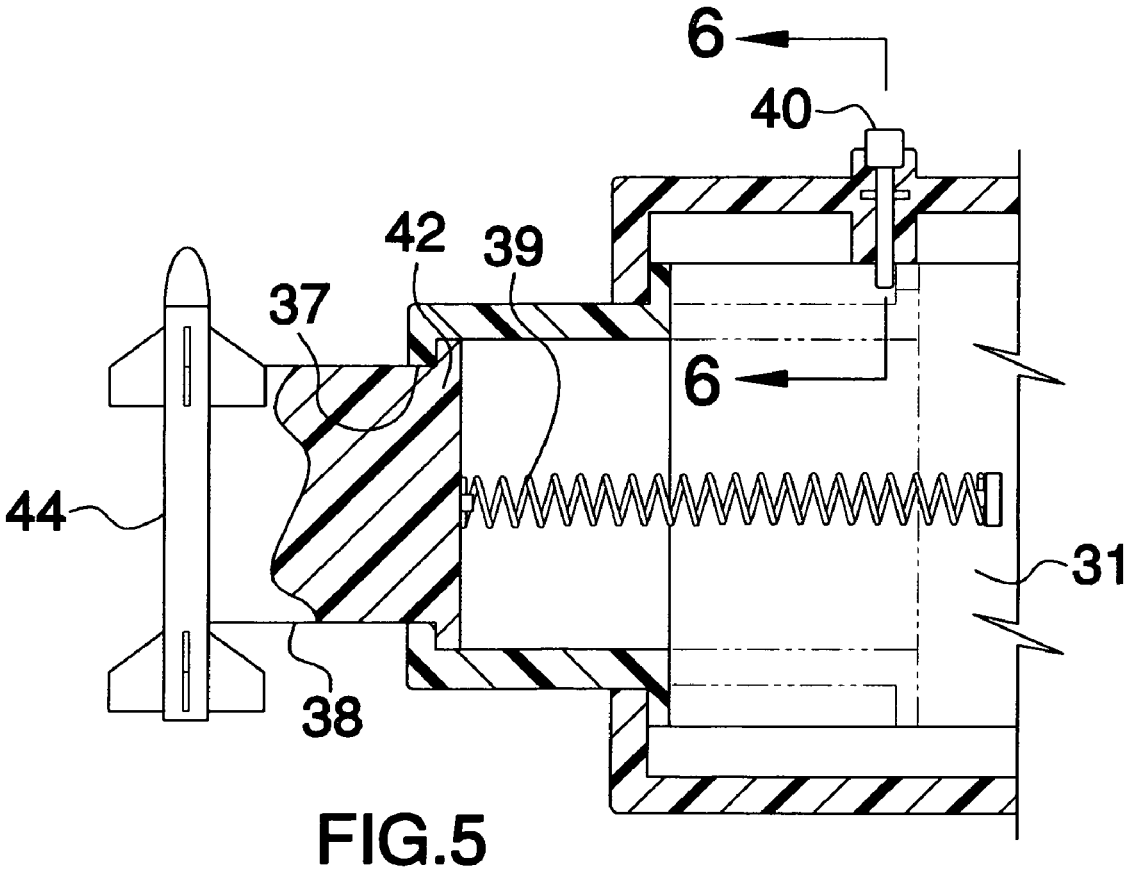
FIG. 5 is a cross-sectional view of a housing of the present invention.
Figure 6:
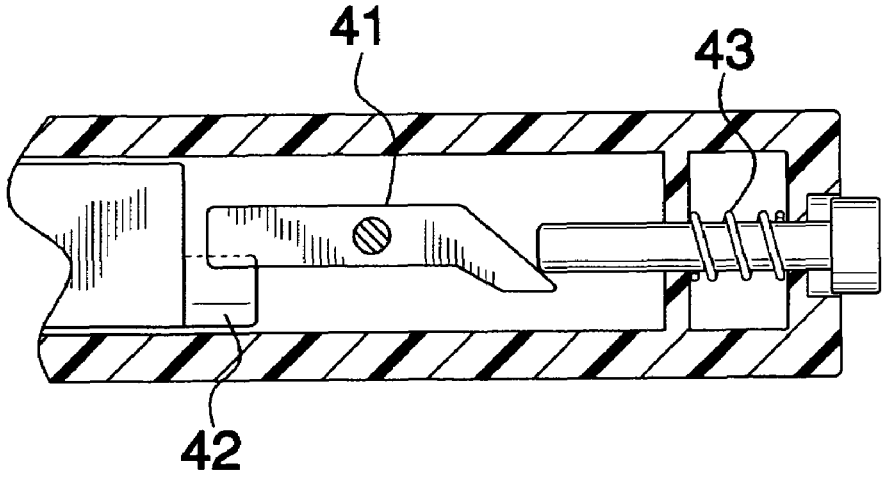
FIG. 6 is a cross-sectional view taken along line 6-6 of FIG. 5 of the present invention.
Figure 7:
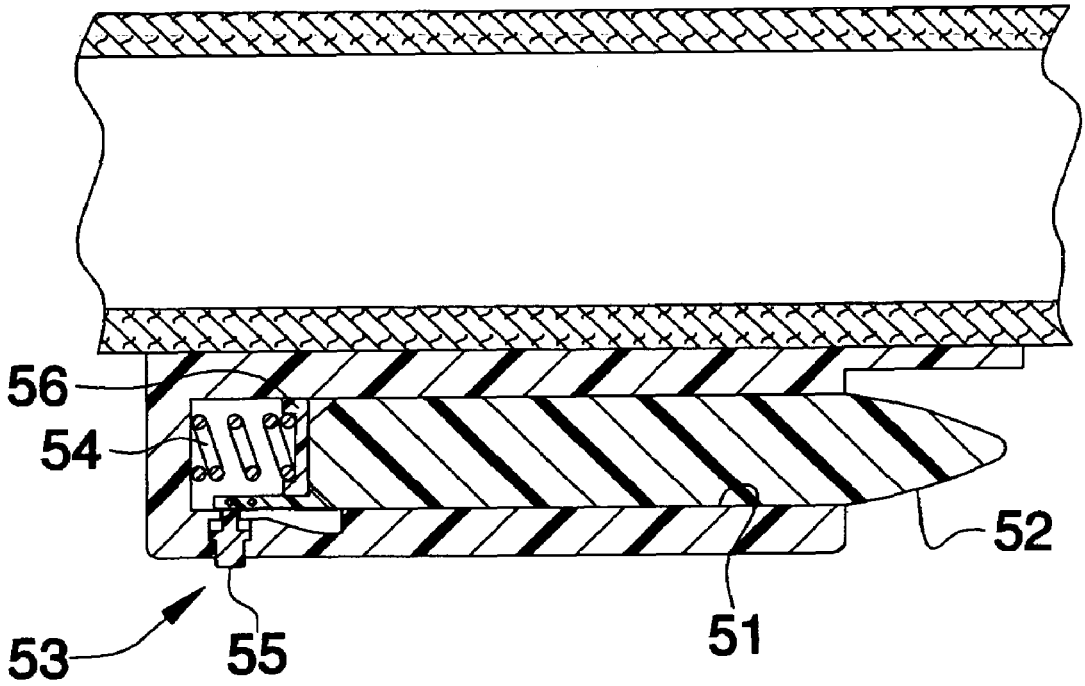
FIG. 7 is a cross-sectional view taken along line 7-7 of FIG. 3 of the present invention.
Figure 8:
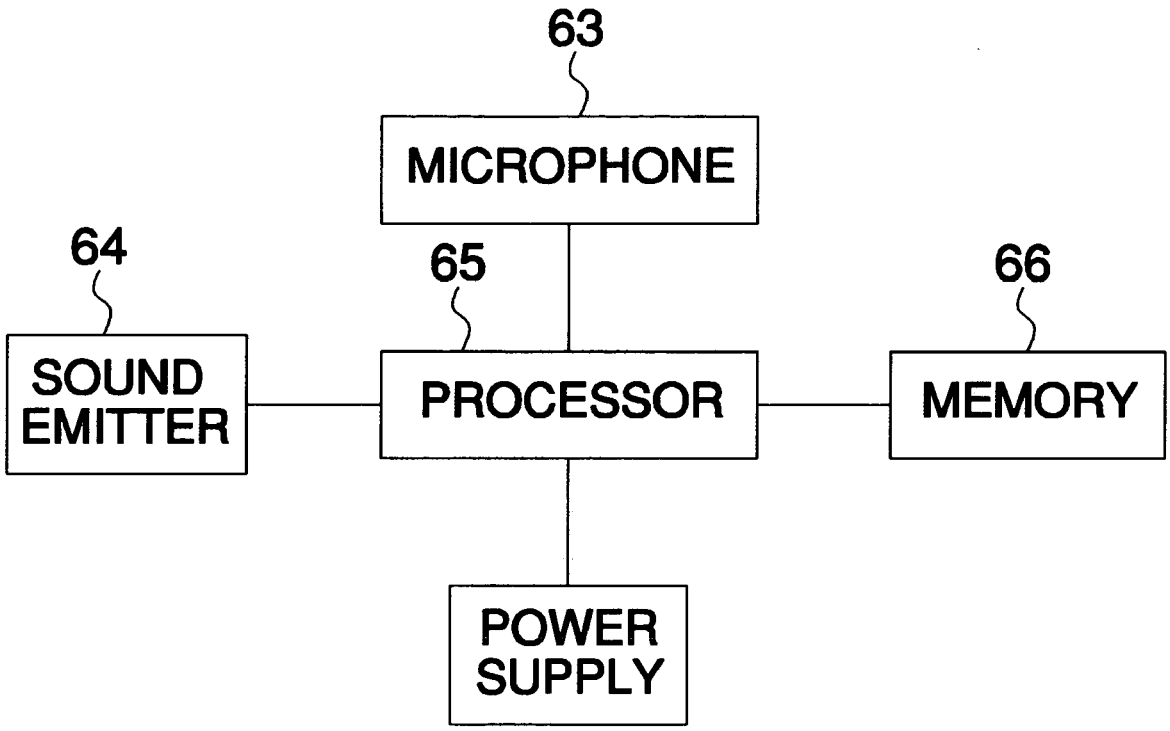
FIG. 8 is a schematic view of the present invention.

A housing 30 is attached to the back covering 17. Optionally, the housing 30 may be removably attached to the housing 30 with conventional fasteners such as snaps, buttons or hook and loop fasteners. The housing 30 has a back wall 31, a front wall 32, a top wall 33, a first side wall 34, a second side wall 35 and a bottom wall 36. Each of the first 34 and second 35 side walls has an elongated vertical slot 37 extending therethrough. A pair of wing assemblies 38 is mounted in the housing 30 and each is removably extendable outwardly out of one of the slots 37. Each of the wing assemblies 38 is biased outwardly out of a corresponding one of the slots by springs 39 as shown in FIG. 5. It should be understood that an opposite side of the housing 30 including the second side wall 35 is a mirror image of FIG. 5. A pair of actuators 40 is mounted on the housing 30. Each of the actuators 40 is configured to engage one of the wing assemblies 38 and retain the wing assemblies 38 within the housing 30. This may be done with a lever 41 that engages a catch 42 on the wing assemblies 38. The actuators 40 release the catch 42, and thereby release the wing assemblies 38 outwardly of the slots 37 when the actuators 38 are actuated. The actuators 38 are biased in a closed position by another spring 43 to hold catch 42 in place. Each of the actuators 38 is positioned on the top wall 33. The wing assemblies 38, as shown in FIG. 5, may be telescoping in nature so that they may extend further outwardly from the housing. The outer edges of the wing assemblies 38 preferably have a toy rocket 44 attached thereto.

A pair of tubular members 45 is provided. Each of the tubular members 45 is shaped like a rocket nozzle. The tubular members 45 are each attached to and directed away from the bottom wall 36.

A pair of missile launchers 50 is provided. Each of the missile launchers 50 is attached to one of the arm coverings 16 and each of the missile launchers 50 includes a plurality of launch tubes 51. The launch tubes 51 are each configured to receive one of a plurality of resiliently compressible darts 52, which are preferably comprised of a foamed elastomeric material. Each of the launch tubes 51 has a firing assembly therein 53. The firing assemblies 53 include a biasing member 54 configured to eject one of the darts 52 outwardly of a corresponding one of the launch tubes 51. Each of the firing assemblies 53 includes a fire button 55 configured to eject a corresponding one of the darts 52. In particular, the biasing member 54 is biased against a plate 56 positioned in the associated one of the launch tubes 51. The fire button 55 engages the plate 56 when the plate 56 is urged against the biasing member 54 with the dart 52. When actuated, the fire button 55 releases the plate 56, which allows the stored energy in the biasing member 54 to force the plate 56 against the dart 52 and thereby eject the dart 52 outwardly of the launch tube 51. The missile launchers 50 may be attached to gloves 57 which are worn on the hands and which are attachable to the arm coverings 16.

A helmet assembly 60 is also provided that includes a helmet 61, which has an open front side 62. The helmet 61 may be constructed of any conventional material, such as a plastic, used for the construction of helmets. A microphone 63 is attached to helmet 61 and extends toward the front side 62. A sound emitter 64 is mounted in the helmet 61 and a processor 65 is electrically coupled to the sound emitter 64 and to the microphone 63. An electronic memory storage device 66 has a plurality of prerecorded sounds electronically stored thereon. The electronic memory storage device 66 is electrically coupled to the processor 65. The processor 65 is configured to access and play the prerecorded sounds on the sound emitter 64 in response to pre-configured sound promptings detected by the microphone 63. This may be accomplished with conventional speech recognition software. The prerecorded sounds may include conventional rocket firing sounds, explosions and the like. The prerecorded sounds may also include spoken words such as "attack" and "fire." Likewise, the sound promptings may be selectively programmed and may include configurations such as the sound of a rocket being fired when the sound prompting is "fire missile."

In use, the upper 15 and lower 12 body portions are placed on the body of a child and the helmet 61 placed on the head of the child. The child may fire the darts 52 from the missile launchers 50 and cause the wing assemblies 38 to extend outwardly from the housing 30. The sound emitter 64 in the helmet 61 provides a more realistic playing environment while the knee 20 and elbow 21 pads protect the child from injury.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A playsuit apparatus comprising:

a lower body covering including a pair of leg coverings;

an upper body covering including a pair of arm coverings, a back covering and a chest covering;

a housing being attached to said back covering, said housing having a back wall, a front wall, a top wall, a first side wall, a second side wall and a bottom wall, each of said first and second side walls having an elongated vertical slot extending therethrough; and a pair of wing assemblies, each of said wing assemblies being positioned in said housing and being removably extendable outwardly out of one of said slots, each of said wing assemblies being biased outwardly out of a corresponding one of said slots, a pair of actuators being mounted on said housing, each of said actuators being configured to engage one of said wing assemblies and retain said wing assemblies within said housing, said actuators releasing said wing assemblies outwardly of said slots when said actuators are actuated.

2. The apparatus according to claim 1, wherein each of said lower and upper body coverings is comprised of a resiliently stretchable material.

3. The apparatus according to claim 1, wherein each of said actuators is positioned on said top wall.

4. The apparatus according to claim 1, further including a pair of tubular members, each of said tubular members being shaped like a rocket nozzle, each of said tubular members being attached to and directed away from said bottom wall.

5. The apparatus according to claim 1, further including a pair of missile launchers, each of said missile launchers being attached to one of said arm coverings, each of said missile launchers including a plurality of launch tubes, each of said launch tubes being configured to receive one of a plurality of resiliently compressible darts, each of said launch tubes having a firing assembly therein, each of said firing assemblies including a biasing member configured to eject one of said darts outwardly of a corresponding one of said launch tubes, each of said firing assemblies including a fire button configured to eject a corresponding one of said darts.

6. The apparatus according to claim 5, further including:

a helmet assembly, said helmet assembly including;

a helmet having an open front side;

a microphone being attached to helmet and extending toward said front side;

a sound emitter being mounted in said helmet;

a processor being electrically coupled to said sound emitter and to said microphone;

an electronic memory storage device having a plurality of prerecorded sounds electronically stored thereon, said electronic memory storage device being electrically coupled to said processor, said processor being configured to access and play said prerecorded sounds on said sound emitter in response to pre-configured sound promptings detected by said microphone.

7. The apparatus according to claim 1, further including:

a helmet assembly, said helmet assembly including;

a helmet having an open front side;

a microphone being attached to helmet and extending toward said front side;

a sound emitter being mounted in said helmet;

a processor being electrically coupled to said sound emitter and to said microphone;

an electronic memory storage device having a plurality of prerecorded sounds electronically stored thereon, said electronic memory storage device being electrically coupled to said processor, said processor being configured to access and play said prerecorded sounds on said sound emitter in response to preconfigured sound promptings detected by said microphone.

8. The apparatus according to claim 1, further including a shield being attached to and generally covering said chest covering.

9. The apparatus according to claim 1, further including:

a pair of knee pads, each of said knee pads being mounted on one of said leg coverings; and a pair of elbow pads, each of said elbow pads being mounted on one of said arm coverings.

10. The apparatus according to claim 5, further including:

a pair of knee pads, each of said knee pads being mounted on one of said leg coverings; and a pair of elbow pads, each of said elbow pads being mounted on one of said arm coverings.

11. A playsuit apparatus comprising:

a lower body covering including a pair of leg coverings and a pair of foot coverings, said lower body covering comprising a resiliently stretchable material;

an upper body covering including a pair of arm coverings, a back covering and a chest covering, said upper body covering comprising a resiliently stretchable material;

a housing being attached to said back covering, said housing having a back wall, a front wall, a top wall, a first side wall, a second side wall and a bottom wall, each of said first and second side walls having an elongated vertical slot extending therethrough;

a pair of wing assemblies, each of said wing assemblies being positioned in said housing and being removably extendable outwardly out of one of said slots, each of said wing assemblies being biased outwardly out of a corresponding one of said slots, a pair of actuators being mounted on said housing, each of said actuators being configured to engage one of said wing assemblies and retain said wing assemblies within said housing, said actuators releasing said wing assemblies outwardly of said slots when said actuators are actuated, each of said actuators being positioned on said top wall;

a pair of tubular members, each of said tubular members being shaped like a rocket nozzle, each of said tubular members being attached to and directed away from said bottom wall;

a pair of missile launchers, each of said missile launchers being attached to one of said arm coverings, each of said missile launchers including a plurality of launch tubes, each of said launch tubes being configured to receive one of a plurality of resiliently compressible darts, each of said launch tubes having a firing assembly therein, each of said firing assemblies including a biasing member configured to eject one of said darts outwardly of a corresponding one of said launch tubes, each of said firing assemblies including a fire button configured to eject a corresponding one of said darts;

a helmet assembly including;

a helmet having an open front side;

a microphone being attached to helmet and extending toward said front side;

a sound emitter being mounted in said helmet;

a processor being electrically coupled to said sound emitter and to said microphone;

an electronic memory storage device having a plurality of prerecorded sounds electronically stored thereon, said electronic memory storage device being electrically coupled to said processor, said processor being configured to access and play said prerecorded sounds on said sound emitter in response to preconfigured sound promptings detected by said microphone;

a shield being attached to and generally covering said chest covering;

a pair of knee pads, each of said knee pads being mounted on one of said leg coverings; and a pair of elbow pads, each of said elbow pads being mounted on one of said arm coverings.

* * * * *